United States Patent [19]

Ogino et al.

[11] Patent Number: 4,663,909

[45] Date of Patent: May 12, 1987

[54] OUTER HEAT INSULATING STRUCTURE ON A BUILDING ROOF

[75] Inventors: Akihiko Ogino; Teruyoshi Ohno, both of Kodaira, Japan

[73] Assignee: Bridgestone Corporation, Tokyo, Japan

[21] Appl. No.: 748,878

[22] Filed: Jun. 26, 1985

[30] Foreign Application Priority Data

Mar. 12, 1985 [JP] Japan ..... 60-47346

[51] Int. Cl.[4] ..... E04B 1/70

[52] U.S. Cl. ..... 52/302; 98/31

[58] Field of Search ..... 52/126.1, 607, 302, 52/303, 663; 404/2, 7, 4; 98/31

[56] References Cited

U.S. PATENT DOCUMENTS

| | | | |
|---|---|---|---|
| Re. 26,366 | 4/1968 | Flegel | 404/2 |
| 687,105 | 11/1901 | Anderson | 52/607 |
| 687,106 | 11/1901 | Anderson | 404/2 |
| 966,187 | 8/1910 | Fischer et al. | 52/302 |
| 2,593,424 | 4/1952 | Edgerly | 52/303 |
| 3,516,347 | 6/1970 | May | 98/31 |
| 4,546,580 | 10/1985 | Ueno et al. | 52/126.1 |

*Primary Examiner*—James L. Ridgill, Jr.

*Attorney, Agent, or Firm*—Sughrue, Mion, Zinn, Macpeak, and Seas

[57] ABSTRACT

An outer heat-insulating structure on a building roof comprising heat-insulating boards arranged longitudinally and laterally on the upper surface of a building body, and holds panels arranged longitudinally and laterally over the heat-insulating boards while a spacing is provided therebetween, said adjacent hold panels being joined together by means of support legs and fixing caps at corners of the hold panels, wherein the peripheral portion of the rooftop outer heat-insulating structure is provided with openings.

5 Claims, 11 Drawing Figures

OUTER HEAT INSULATING STRUCTURE ON A BUILDING ROOF

BACKGROUND OF THE INVENTION (1) Field of the Invention:

The present invention relates to an outer heat insulating structure on a building roof. More particularly, the invention relates to improvement on the outer heat insulating structure on the building roof, which structure is designed such that while heat insulating boards are closely arranged longitudinally and laterally on the surface of the roof of the building, hold panels are also closely arranged longitudinally and laterally in a plane while being upwardly spaced from the heat insulating boards.

(2) Description of the Prior Art:

The temperature which a human body feels in a room depends upon room temperature as well as radiation heat from a ceiling surface. For this reason, there have been proposed outer heat insulating structures on the building roofs particularly in the case of the concrete buildings so that the heat insulating boards are closely spread all over the roof. Such heat insulating structures can warm the entire building, mitigate cooling-down particularly early in the morning, interrupt direct sunshine in summer, prevent roof slabs from accumulating heat through utilization of proper ventilation and shading effect, and eliminate sultriness at night which may be caused by accumulated heat.

The conventional outer heat insulating structures of this type generally have a unit structure to make the installation and removal thereof facilitated and them to be easily applied to newly constructed buildings as well as existing buildings. As shown in FIG. 11, heat insulating boards 4 are closely arranged longitudinally and laterally in a plane spaced upwardly while a spacing 3 (the lower air layer) is kept between the upper surface 1*a* of a body of a building and the boards, and hold panels 6 are arranged longitudinally and laterally in a plane spaced upwardly while a spacing 5 (the upper air layer) is kept between the heat insulating boards and the hold panels. The corner portions of the adjacent panels are held up by support legs 7 supported by the building body, and the panels are integrally tightened by means of fixing caps 9.

Such an outer heat insulating structure on the building roof has merits in that since the heat insulating boards are closely paved over the upper surface of the building body while being spaced therefrom, the heat insulating effect can be enhanced by the double heat insulating structure consisting of the air layers and the heat insulating boards, and that even when rain, snow and the like enters the interior of the heat insulating structure, it can be dried to its original state through spontaneous ventilation due to the presence of the air layers, thereby keeping the heat insulating performance at a high level for a long period of time.

However, since there exists the space under the hold panels, when a strong wind A such as in a typhoon blows as shown in FIG. 11, the hold panels are sucked upwardly by a suction force F produced due to the difference in pressure $P_1$ and $P_2$ formed on the upper and lower sides of the hold panels 6, that is, the negative pressure produced by a high speed stream on the upper side, so that there is a problem that the panels are peeled off and scattered to the surrounding area.

It is necessary from the standpoint of safety to assuredly prevent the hold panels from being peeled off by the difference in pressure caused between the upper and lower sides of the hold panel as mentioned above.

For this reason, according to the conventional structures, the hold panels are made of concrete to have enough weight to withstand local wind pressure, or alternatively, the panels are directly fixed to the building body by means of anchors, an adhesive or the like. However, if the panels are made heavier, there only rises a danger when the weight of the panels exceeds the tolerable superimposed load capacity of the building, but also the durable life of the building is caused to be shortened. Further, there occurs a problem in building construction is that the heavier the panel, the poorer are the constructing performance and maintenance property. On the other hand, in the case that the hold panels are directly bound to the building body, there may occur the fatal defects that the constructing workability and the maintenance property become poor, but also the water-proof layer is damaged.

SUMMARY OF THE INVENTION

It is therefore an object of the present invention to provide an outer heat insulating structure on a building roof which eliminates the drawbacks encountered by the prior art.

More specifically, it is the object of the present invention to provide an outer heat insulating structure on a building roof in which wind pressure tolerable performance is enhanced by improving the structure without making the weight of a hold panel heavier and without the hold panel being directly bound to the body of a building.

According to the present invention, there is a provision of an outer heat-insulating structure on a building body comprises heat-insulating boards arranged longitudinally and laterally on the upper surface of a building body, and hold panels arranged longitudinally and laterally over the heat-insulating boards while a spacing is provided therebetween, said adjacent hold panels being joined together by means of support legs and fixing caps at corners of the hold panels, wherein the peripheral portion of the outer heat-insulating structure on a building roof is provided with opening.

According to another aspect of the present invention, there is a provision of an outer heat insulating structure on a building roof in which heat insulating boards are longitudinally and laterally arranged over the upper surface of a body of a building; hold panels are arranged longitudinally and laterally over the heat insulating panels while a spacing is kept between the hold panels and the heat insulating panels; the corners of the adjacent hold panels are joined together by means of support legs and fixing caps; and an end block member is arranged around the peripheral portion of the roof panel layer, said outer heat insulating structure being characterized in that openings are formed in the end block member to communicate the interior of the space under the hold panels with the outside.

According to still another aspect of the present invention, there is a provision of an outer heat insulating structure on a building roof in which heat insulating boards are longitudinally and laterally arranged over the upper surface of a body of a building, hold panels are arranged longitudinally and laterally over the heat insulating panels while a spacing is kept between the hold panels and the heat insulating panels; the corners of the adjacent panels are supported by support legs held on the upper surface of the roof of the building, and are integrally tightened to the support legs by means of fixing caps, the outer heat insulating structure on the building roof being characterized in that openings are formed in the hold panels positioned at the peripheral portion of the roof to communicate the space under the panels with the outside.

According to the outer heat insulating structure on the building roof of the present invention, since the difference in pressure between the upper and lower sides of the hold panels which difference is produced when a strong wind blows can be reduced to a large extent by the provision of the openings in the end block member surrounding the periphery of the hold panel layer or in the panels positioned in the peripheral portion of the roof at which the local wind pressure the largest, the upward suction force due to the negative pressure becomes smaller. Thus, the fear that the hold panels may be peeled off and scattered outside by a strong wind can be diminished.

These and other objects, features and advantages of the invention will be well appreciated upon reading of the following description of the invention when taken in connection with the attached drawings with understanding that some modifications, variations and changes could be easily done by the skilled in the art to which the invention pertains without departing from the spirit of the invention or scope of the claims appended hereto.

DESCRIPTION OF THE DRAWINGS

For a better understanding, reference is made of the attached drawings, wherein.

DETAILED DESCRIPTION OF PREFERRED EMBODIMENTS ACCORDING TO THE INVENTION

Figure 1:
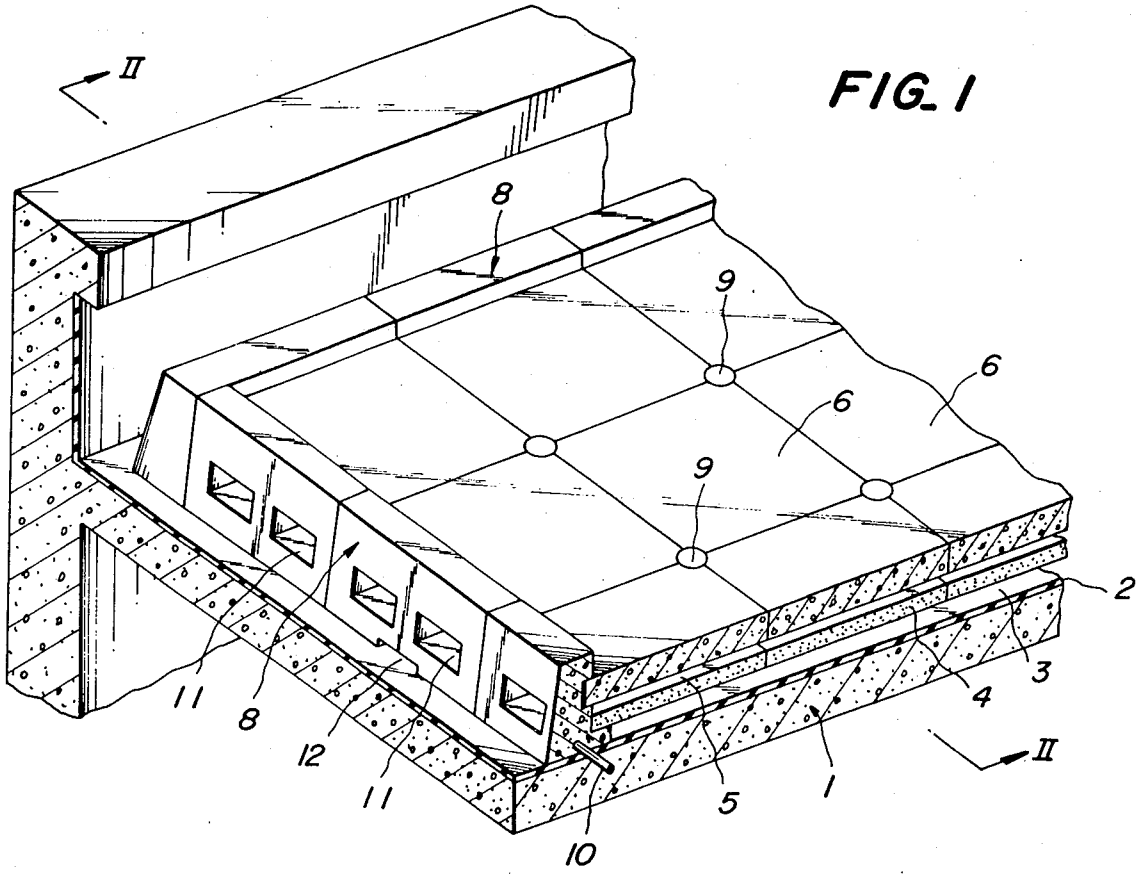
FIG. 1 is a partially sectional perspective view of an embodiment of the outer heat insulating structure on a building roof according to the present invention.

The invention will be described more in detail with referring to the drawings attached hereto. Throughout the drawings, the identical reference numerals denote the same or similar parts.

Figure 2:
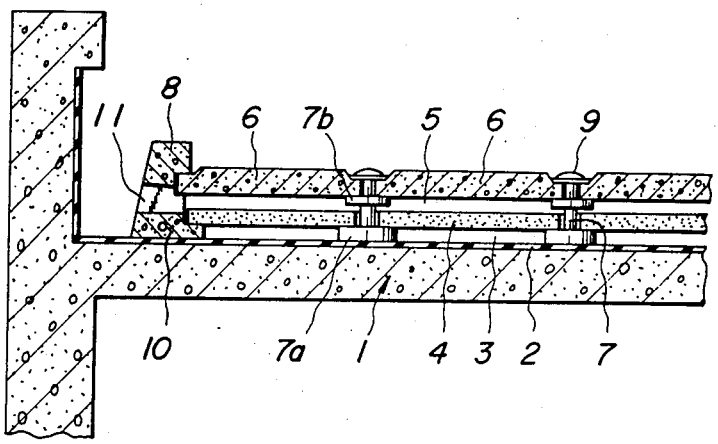
FIG. 2 is a vertically sectional view of FIG. 1 taken along a line II—II.
Figure 3:
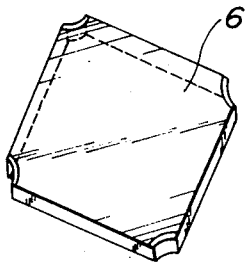
FIG. 3 is a perspective view of a hold panel shown in FIG. 1.

In FIGS. 1–3 is shown an embodiment of the outer heat insulating structure on a building roof according to the present invention.

As shown in FIGS. 1–3, a water-proof layer 2 is formed on the upper surface of a building body 1 forming a rooftop slab of a concrete building, and a plurality of heat insulating boards 4 are closely arranged longitudinally and laterally over the waterproof layer while a spacing (the lower air layer) 3 is provided therebetween. Further, a plurality of hold panels, or roof panels, 6 are closely arranged longitudinally and laterally over the heat insulating boards while a spacing (the upper air layer) 5 is kept therebetween.

The heat insulating board 4 is made of, for instance, a plastic foam such as hard urethane foam, and is designed as a unit board having a dimension of, for example, 80 cm both in length and breadth and 2–5 cm in thickness.

The hold panel 6 is made of, for example, concrete in a shape of 40 cm both in length and breadth and about 4–6 cm in thickness. In the illustrated embodiment, a unit board having the same length and breadth as those of the hold panel 6 is used as the heat insulating board 4.

Each heat insulating board 4 is supported by lower stage support portions *7a* of support legs 7 at its corner portions (also at the central portions if the heat insulating board is wider than the hold panel) (see FIG. 2), and the peripheral portion of the heat insulating layer which is constituted by closely paving the heat insulating boards 4 is supported by an end block member 8 made of concrete.

Each hold panel 6 is supported by an upper stage support portion *7b* of the support leg 7 at the corner portions, and is joined to the adjacent hold panels by engaging fixing caps 9 into the support legs 7. The end block member 8 is arranged around the peripheral portion of the layer in which the hold panels 6 are closely arranged to support the panels in the state that the hold panels are pressed down or prevented from moving in the suspended posture by the end block member.

The support leg 7 is mounted on the upper surface of the building body 1 (in the illustrated embodiment, on the water-proof layer 2 provided on the upper surface of the building body), and the upper and lower stage support portions are vertically adjustable so that even when the upper surface of the building body 1 is uneven, the panels can be paved at the same level.

In the illustrated embodiment, the end block member 8 has the structure that block unit having substantially the same length as the side of the panel 6 are connected together by a reinforcing bar 10 passing through holes bored in the block units. Openings 11 are formed in the end block member for communicating the space under the panels 6, that is, the upper air layer 5 with the outside. It may be that the reinforcing bar is omitted, and only the end block member 8 is installed.

The openings are so arranged that when a strong wind blows, the wind passes on the upper surface side as well as on the lower surface side. In this embodiment, the openings are formed in a form of a window in the surrounding end block member 8 at a specific interval. The outer open periphery of the opening 11 may be in a taper form, e.g. in a horn profile to facilitate the introduction of the wind into the spacing 5.

When a strong wind passes the upper surface side of the hold panels 6, there is the possibility that the panels 6 are sucked upwardly by a negative pressure suction force produced by the high speed stream, and peeled off or scattered to the surrounding. In the structure of the embodiment shown in FIGS. 1–3, the difference in the pressure between the upper and lower surface sides of the panels due to the strong wind can be reduced through the formation of the openings 11 in the end block member 8, so that the peeling-off and the scattering of the panels can be assuredly prevented.

The total open area, the profile and the arrangement of the openings 11 may be appropriately determined taking into account the degree in the elimination of the reduction of the pressure difference as mentioned above.

Reference numeral 12 in FIG. 1 denotes a water discharge opening for discharging water collecting on the water-proof layer 2 (or the upper surface of the building body 1).

According to the aforementioned embodiment, since the openings 11 are formed in the end block member 8 for communicating the outside with the space under the hold panels, the difference in pressure between the upper and lower sides of the panels can be lessened even at the time of a strong wind blowing. Thereby, the panels 6 can be prevented from lifting up, peeling off or scattering in the case of the typhoon or the like to offer the outer heat insulating structure on the building roof which structure is excellent in reliability and safety.

Figure 4:
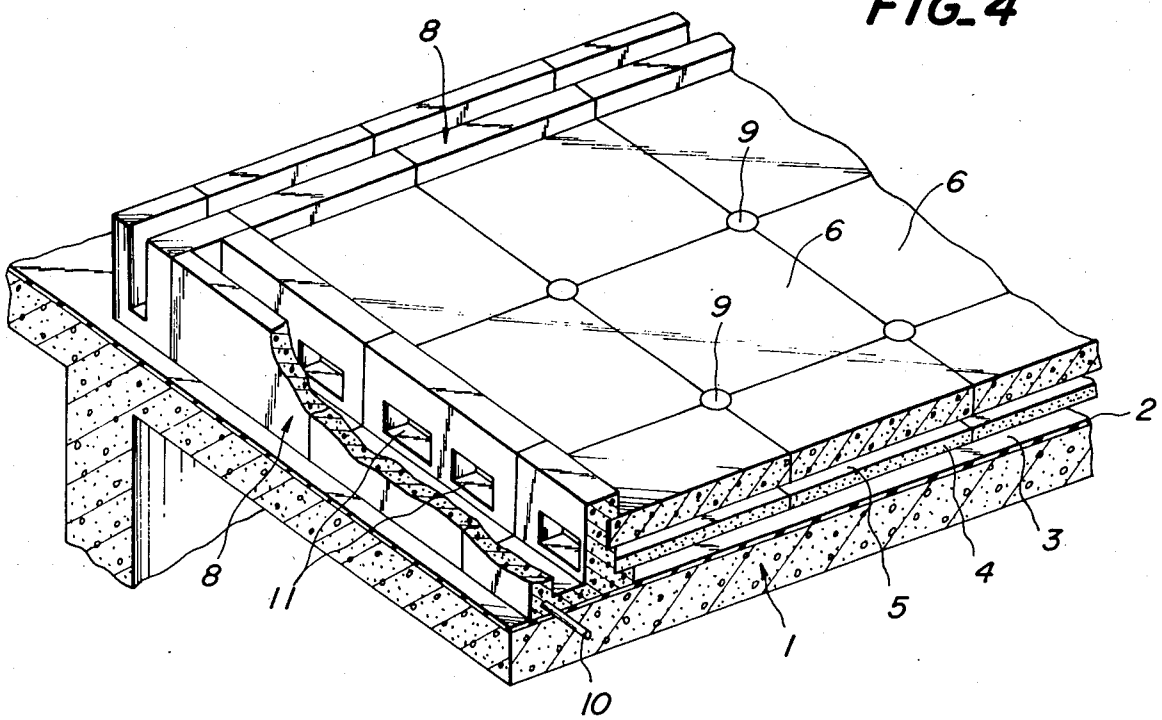
FIG. 4 is a partially sectional perspective view of another embodiment of the outer heat insulating structure on a building roof according to the present invention.

FIG. 4 shows another embodiment according to the present invention. In this embodiment, a member having almost V-shape in section are used as the end block member 8, and are provided with openings 11 at the inner wall portions thereof. This embodiment is substantially the same as the previously mentioned one except that the configuration and the structure of the end block member 8 of the latter differ from those of the former. Accordingly, the corresponding parts are denoted by the identical reference numerals, and detailed explanation thereon is omitted.

According to the embodiment in FIG. 4, since the spacing (the upper air layer) 5 under the panels 6 is communicated with the outside through the openings 11 and a top-open groove of the end panel, as in the case with the previously mentioned embodiment, the difference in pressure between the upper and lower surfaces of the panels at the time of the strong wind blowing can be reduced. Therefore, as in the case with the previously mentioned embodiment, the panels can be prevented from lifting, peeling off or scattering, thereby obtaining the outer heat insulating structure on the building roof which structure is excellent in reliability and safety.

In this embodiment, the number, total open area, profile, arrangement and so on of the openings 11 may be appropriately determined taking the elimination or reduction of the pressure difference into consideration.

In the aforementioned embodiments, the structure in which relatively short units are joined together by the reinforcing bar is employed as the end block member 8, but long and relatively heavy block units may be used. In this case, the reinforcing bar 10 may be omitted.

Figure 5:
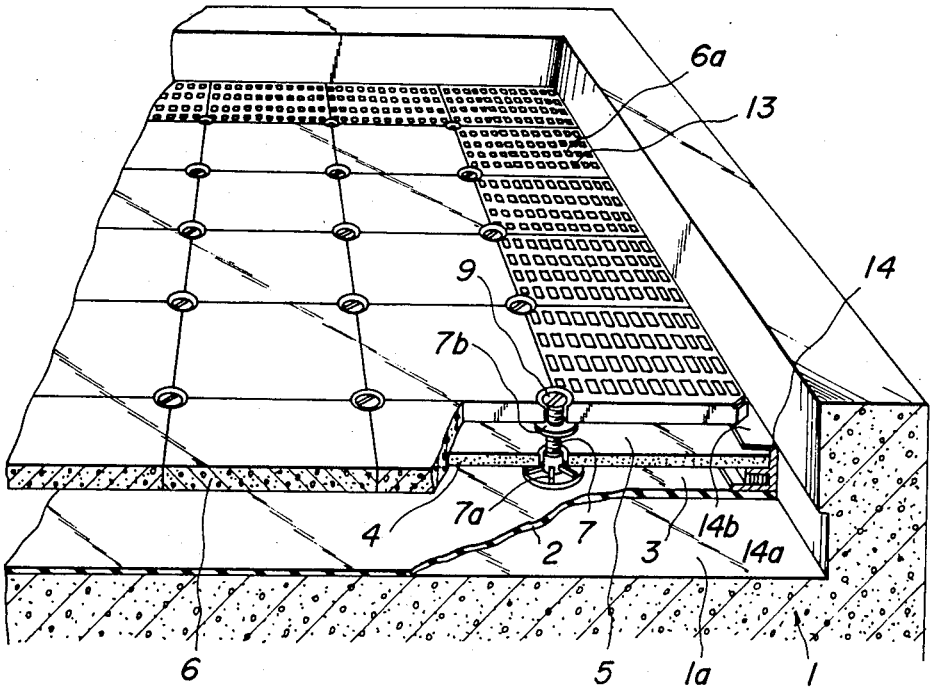
FIG. 5 is a partially sectional perspective view of the outer heat insulating structure on a building roof according to the present invention.

FIG. 5 shows a still another embodiment of the outer heat insulating structure on a building roof, which is of a wind pressure-proof type, according to the present invention.

The identical reference numerals in FIG. 5 show the same parts as in the previously described embodiments, and therefore detailed explanation thereon is omitted.

The heat insulating boards 4 and the hold panels 6 are supported by the support legs 7 at the corner portions thereof in the same manner as the previous embodiments, and the sides thereof at the peripheral portion of the roof are supported by an end support member 14. Namely, the end support member 14 is designed in a two-stage shelf shape, and the sides of the heat insulating boards 4 at the peripheral portion of the roof are held on the lower stage shelf portion **14*a*, while the sides of the hold panels 6 are held on the upper stage shelf portion 14*b***.

Figure 7:
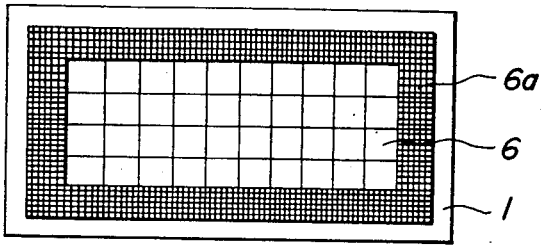
FIGS. 7–9 are schematic views illustrating arrangements of the air-permeation panels at the peripheral portion of the rooftop.
Figure 8:
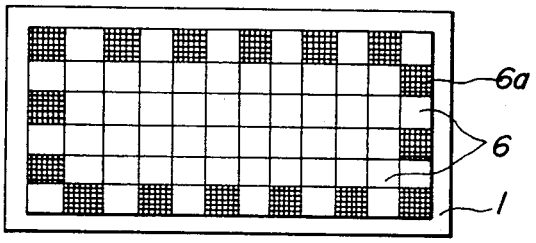
Figure 9:
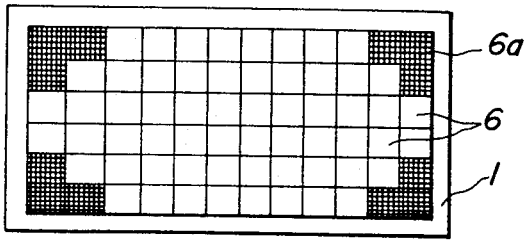

Numerous openings 13 are provided in the hold panels at the peripheral portion of the rooftop. That is, as shown in FIG. 5, air permeation panels **6*a* are provided instead of the hold panels 6 at the peripheral portion of the rooftop. Preferably, the air permeation panels 6*a* are provided all over the entire peripheral portion as schematically illustrated in FIG. 7, but the installation position may be modified as needed. For instance, as shown in FIG. 8, the air permeation panels 6*a* and the hold panels 6 are alternatively arranged along the peripheral portion of the rooftop. Or, as shown in FIG. 9, the air permeation panels 6*a*** may be arranged at the corner portions of the peripheral portion of the rooftop.

Figure 6:
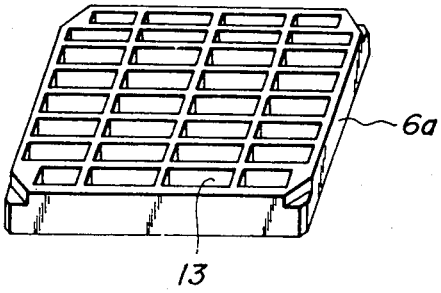
FIG. 6 is a perspective view of an air-permeation panel.

The air permeation panel **6*a* is provided with openings 13 in a lattice fashion as shown in FIG. 6**. But, the air permeation is not necessarily restricted to this type. Any profile of the opening may do so long as well air permeation can be maintained.

Figure 10:
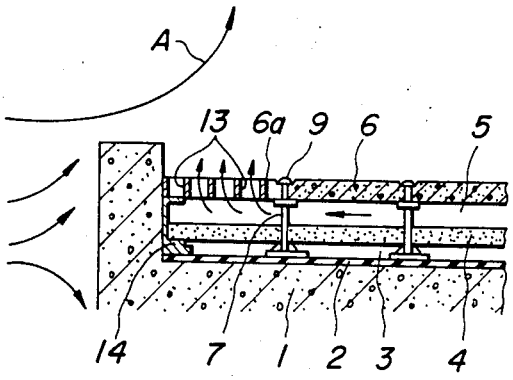
FIG. 10 is a partially sectional view of the outer heat insulating structure on the building roof shown in FIG. 5.
Figure 11:
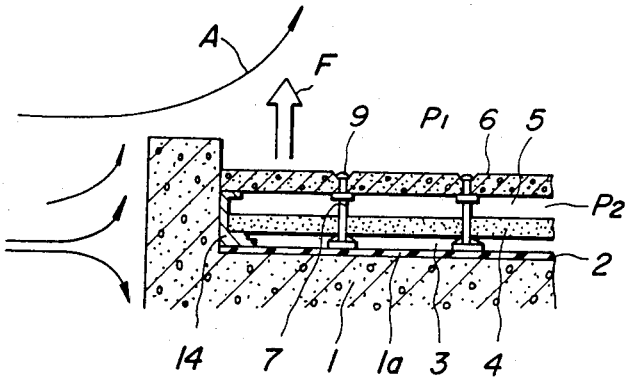
FIG. 11 PRIOR ART
FIG. 11 is a partially vertically sectional view of a conventional outer heat insulating structure on a building roof.

As understood from FIG. 10, according to the present invention, since the space 5 under the hold panels 6 communicates with the exterior through the air permeation openings 13 of the air permeation panels **6*a***, the difference in pressure between the upper and lower surface sides of the panels at the time of the strong wind blowing can be reduced.

As mentioned above, according to the present invention, since the difference in pressure between the upper and lower surface sides of the panels can be prevented from developing, the hold panels can be also prevented from rising, peeling off or scattering, thereby offering the outer heat insulating structure on the buiding roof.

What is claimed is:

1. An outer heat-insulating structure on a building roof, comprising heat-insulating boards arranged longitudinally and laterally on the upper surface of a building body, and hold panels arranged longitudinally and laterally over the heat-insulating boards while a spacing is provided therebetween, said adjacent hold panels being joined together by means of support legs, fixing caps at the corner portions of the hold panels, and means connected at a peripheral portion of the outer heat-insulating structure provided with openings to establish communication between said spacing and outside said structure; whereby during a condition of strong winds above the hold panels, a difference in pressure beween above and below the hold panels is mitigated due to the openings establishing communication between said spacing and outside said structure thereby preventing the peeling off of the hold panels.

2. The outer heat-insulating structure on the building roof claimed in claim 1, wherein said means at a peripheral portion comprises an end block member provided around the heat insulating boards and the hold panels at the peripheral portion of the outer heat insulating structure, wherein said openings are provided in the end block member, and the heat insulating boards and the hold panels at the peripheral portion of the outer heat insulating structure are supported by said end block member.

3. The outer heat insulating structure on the building roof claimed in claim 1, wherein a water-proof layer is arranged on the roof under the heat-insulating board.

4. The outer heat insulating structure on the building roof claimed in claim 1, wherein said means comprises openings provided in the hold panels at the peripheral portion of the outer heat insulating structure.

5. The outer heat insulating structure on the building roof claimed in claim 4, wherein the heat insulating boards and the hold panels at the peripheral portion of the outer heat insulating structure are supported by an end support member.

* * * * *